US007058190B1

(12) United States Patent
Zakarauskas et al.

(10) Patent No.: US 7,058,190 B1
(45) Date of Patent: Jun. 6, 2006

(54) ACOUSTIC SIGNAL ENHANCEMENT SYSTEM

(75) Inventors: Pierre Zakarauskas, Vancouver (CA); Richard Sones, Vancouver (CA); Rod Rempel, Port Coquitlane (CA); Frank Linseisen, Vancouver (CA)

(73) Assignee: Harman Becker Automotive Systems-Wavemakers, Inc., Vancouver (CA)

( * ) Notice: Subject to any disclaimer, the term of this patent is extended or adjusted under 35 U.S.C. 154(b) by 0 days.

(21) Appl. No.: 09/576,656

(22) Filed: May 22, 2000

(51) Int. Cl.
*H04R 3/00* (2006.01)

(52) U.S. Cl. ..... 381/122; 381/58; 700/94; 434/307 R; 84/610

(58) Field of Classification Search ..... 381/122–123, 381/58, 56, 91, 106, 110, 92, 26, 95, 71.12, 381/318, 316, 98, 108, 111–115; 434/307 A, 434/307 R, 319; 84/610; 700/94; 704/200, 704/270, 83, 93
See application file for complete search history.

(56) References Cited

U.S. PATENT DOCUMENTS 5,029,215 A * 7/1991 Miller, II ..... 381/58
5,400,406 A * 3/1995 Heline, Jr. et al. ..... 381/58
5,590,241 A * 12/1996 Park et al. ..... 704/227
5,714,997 A * 2/1998 Anderson ..... 348/39
5,737,407 A * 4/1998 Graumann ..... 379/388.04
5,764,779 A * 6/1998 Haranishi ..... 381/71.1
5,818,949 A * 10/1998 Deremer et al. ..... 381/172
5,822,718 A * 10/1998 Bakis et al. ..... 702/180
5,949,886 A * 9/1999 Nevins et al. ..... 381/57
6,130,949 A * 10/2000 Aoki et al. ..... 381/94.3
6,141,426 A * 10/2000 Stobba et al. ..... 381/110
6,201,537 B1 * 3/2001 Yoon ..... 345/327
6,249,275 B1 * 6/2001 Kodama ..... 345/173

* cited by examiner

*Primary Examiner*—Huyen Le
*Assistant Examiner*—Lun-See Lao
(74) *Attorney, Agent, or Firm*—Brinks Hofer Gilson & Lione

(57) ABSTRACT

System and method for automatically measuring and monitoring the quality of acoustic data is disclosed. The system also provides suggestions for corrective actions to the system or user. The method monitors the quality of data and provides feedback to the system or user for corrective actions. The quality of data includes a combination of either a signal clipping detector, a microphone ON/OFF detector, an air puff detector, and a low signal-to-noise ratio detector.

8 Claims, 5 Drawing Sheets

ACOUSTIC SIGNAL ENHANCEMENT SYSTEM

BACKGROUND

The present disclosure relates to systems and methods for measuring and monitoring the quality of a speech signal and providing the system and user with corrective action suggestions.

In the field of human-machine speech interface, automatic speech recognition, and voiced telecommunication, the quality of speech data is often degraded by a number of factors. The degradation factors include improper placement of microphone, improper amplifier gain, microphone being turned off unknowingly, speaker voice quality and level, or noise interference. This results in system performance degradation and unsatisfactory user experience.

The prior art systems attempt to control the on/off state of the microphone using a hardware switch, often under control of the user. However, information about the on/off state of the microphone often may not get passed on to the rest of the system. This oversight may result in system failure and user frustration. Further, the prior art systems fail to take into consideration the difference between noise and signal, and therefore attempt to control the microphone gain based on the amplitude of the noise and signal.

SUMMARY

The present disclosure includes methods, systems, and computer programs to continuously and automatically monitor the quality of an acoustic signal and provide feedback to the system or user for corrective actions. The input signal may represent human speech, but it should be recognized that the system may be used to monitor any type of acoustic data, such as musical instruments.

The preferred embodiment of the invention monitors input data as follows. An input signal is digitized into binary data. The digitized time series is analyzed to determine if the microphone is on or off. If the microphone is deemed to be in a different state than that expected by the system, a message is provided to the user or system suggesting a corrective action, such as turning the microphone on. The system can also take internal actions, such as refrain from adjusting to the data, since it does not correspond to acoustic data.

The acoustic data is then transformed to the frequency domain. The data is analyzed in the frequency domain to measure its quality, such as signal-to-noise ratio. If the quality of the data is poor, a message is passed on to the user or system suggesting a corrective action.

The quality of the data is continuously analyzed so that even if the quality is good at the beginning but degrades later on, the degradation is still detected and acted upon. This continuous and automatic monitoring of data quality and the ensuing user feedback provides the user with an overall more satisfying experience than would otherwise occur.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference numbers and designations in the various drawings indicate like elements.

DETAILED DESCRIPTION

Throughout this description, the embodiments and examples shown should be considered as exemplars rather than as limitations of the invention.

The inventors recognized that it would be desirable to have a monitoring system that enables automatic and continuous monitoring of a speech signal quality. The monitored data may be used to determine which factors are responsible for non-optimum quality. The monitoring system may supply the user or audio system with appropriate feedback for corrective actions. The present disclosure also provides a method for, enabling such a monitoring system.

Figure 1:
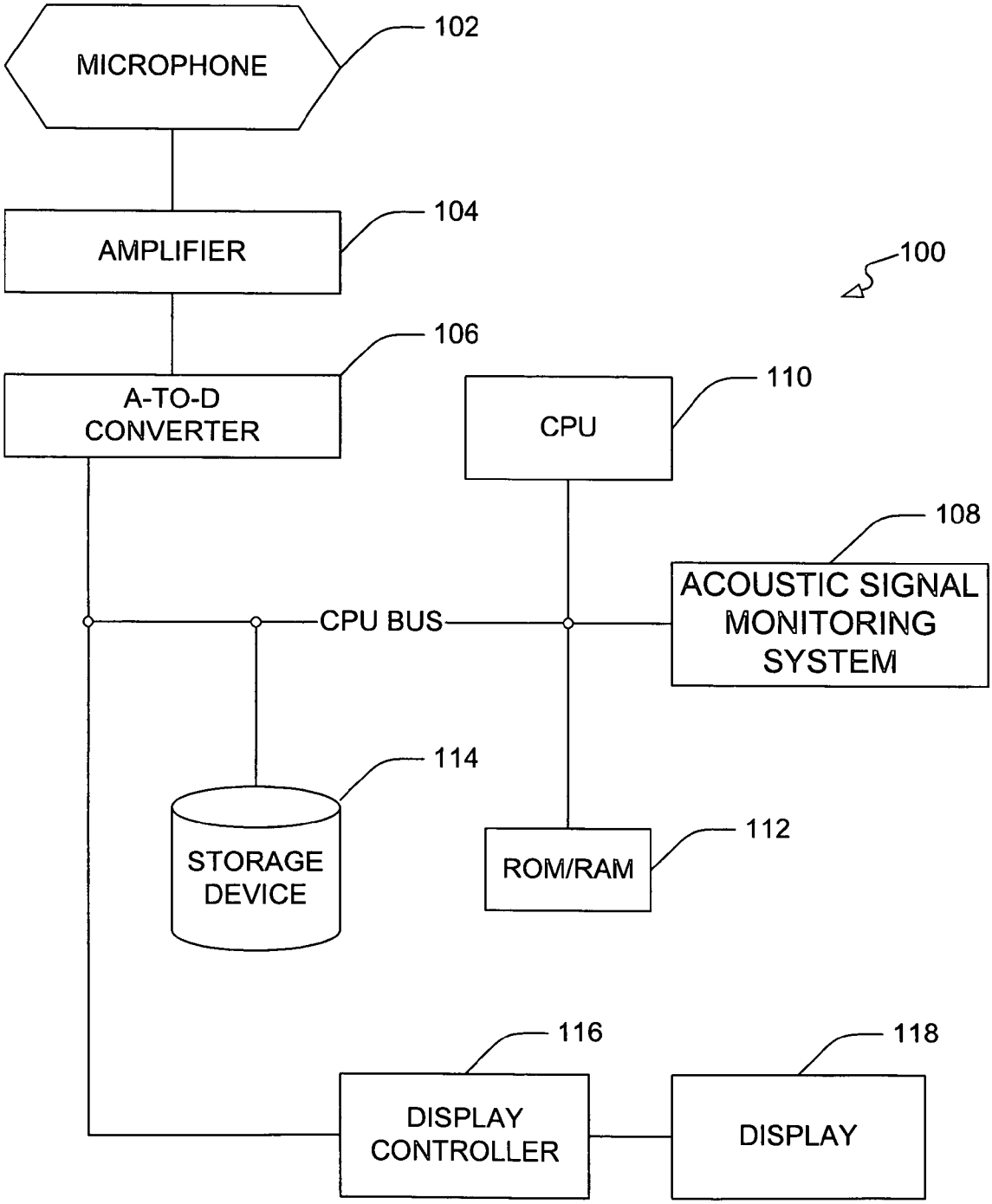
FIG. 1 is a block diagram of a programmable processing system in accordance with an embodiment of the present invention.

FIG. 1 shows a block diagram of a programmable processing system 100 in accordance with an embodiment of the present invention. The processing system 100 may be used for implementing an acoustic signal monitoring system 108. In one embodiment, the processing system 100 also includes a processor 110, memory 112, a display controller, and a user display 118. The user display 118 may be a system that provides corrective actions as a video or audio feedback.

In the illustrated embodiment, an acoustic signal is received at a transducer microphone 102. The transducer microphone 102 generates corresponding electrical signal representation of the acoustic signal. An amplifier 104 may amplify the electrical signal from the transducer microphone 102. The amplified signal may then be converted to a digital signal by an A-to-D converter 106.

The output of the A-to-D converter 106 is applied to the processing system 100. The processing system 100 may include a CPU 110, memory 112, and a storage device 114, coupled to a CPU bus as shown. The memory 112 may include writable memory such as a flash ROM. The storage device 114 may be any storage device, such as a magnetic disk, that enables storage of data.

The acoustic signal monitoring system 108 performs below-described monitoring and classification techniques to the acoustic signal. The status and output of the acoustic signal monitoring system 108 may be displayed for the benefit of a human user by means of a display controller 116. The display controller 116 drives a display 118, such as a video or sound display. The output may also be used by the audio system to adjust its parameters, such as amplifier gain.

Figure 2:
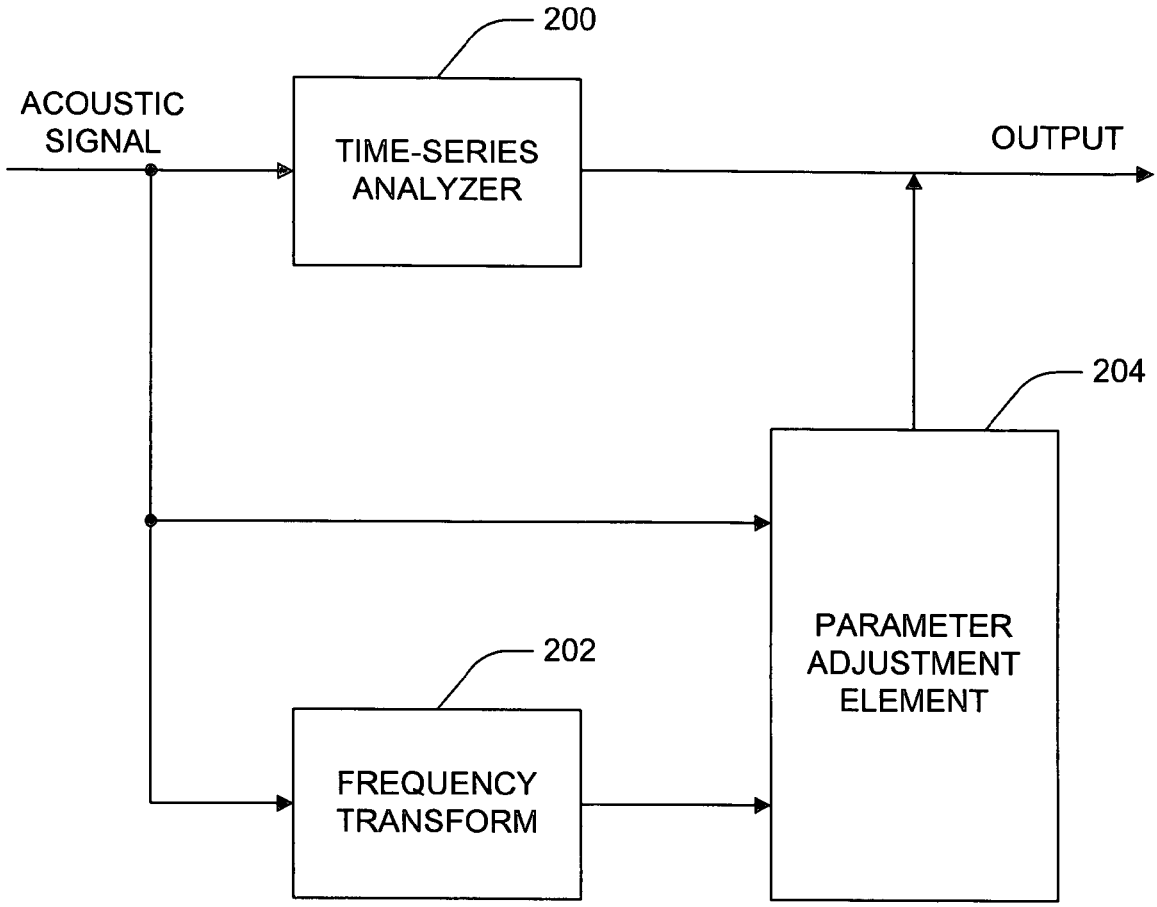
FIG. 2 is a block diagram of an acoustic signal monitoring system according to an embodiment of the present invention.

A block diagram of the acoustic signal monitoring system 108 according to an embodiment of the present invention is shown in FIG. 2. The monitoring system 108 includes a time-series analyzer 200, a frequency transform 202, and a parameter adjustment element 204.

The time-series analyzer 200 performs detection of the microphone's on/off state. The analyzer 200 may also monitor and control the overall gain of an audio system. In some embodiments, the time-series analyzer 200 adjusts amplifier gains to substantially reduce clipping or overloading of the amplifier. In other embodiments, the time-series analyzer 200 monitors and reports these undesirable conditions to the user and/or the audio system.

The frequency transform 202 performs transformation of incoming acoustic signal into frequency domain for signal analysis in the frequency domain. The transformed signal is then directed to the parameter adjustment element 204. The parameter adjustment element 204 is a joint analysis of the time series and the spectrum. The element 204 performs detection of the microphone position with respect to the audio source. For example, the microphone may be positioned too close to the mouth airflow direction causing "puffing" sound. In another example, the microphone may be too far away from the audio source having poor signal-to-noise ratio. A report may be generated as an output to report these undesirable conditions to the user suggesting a list of corrective actions appropriate to the situation.

Figure 3:
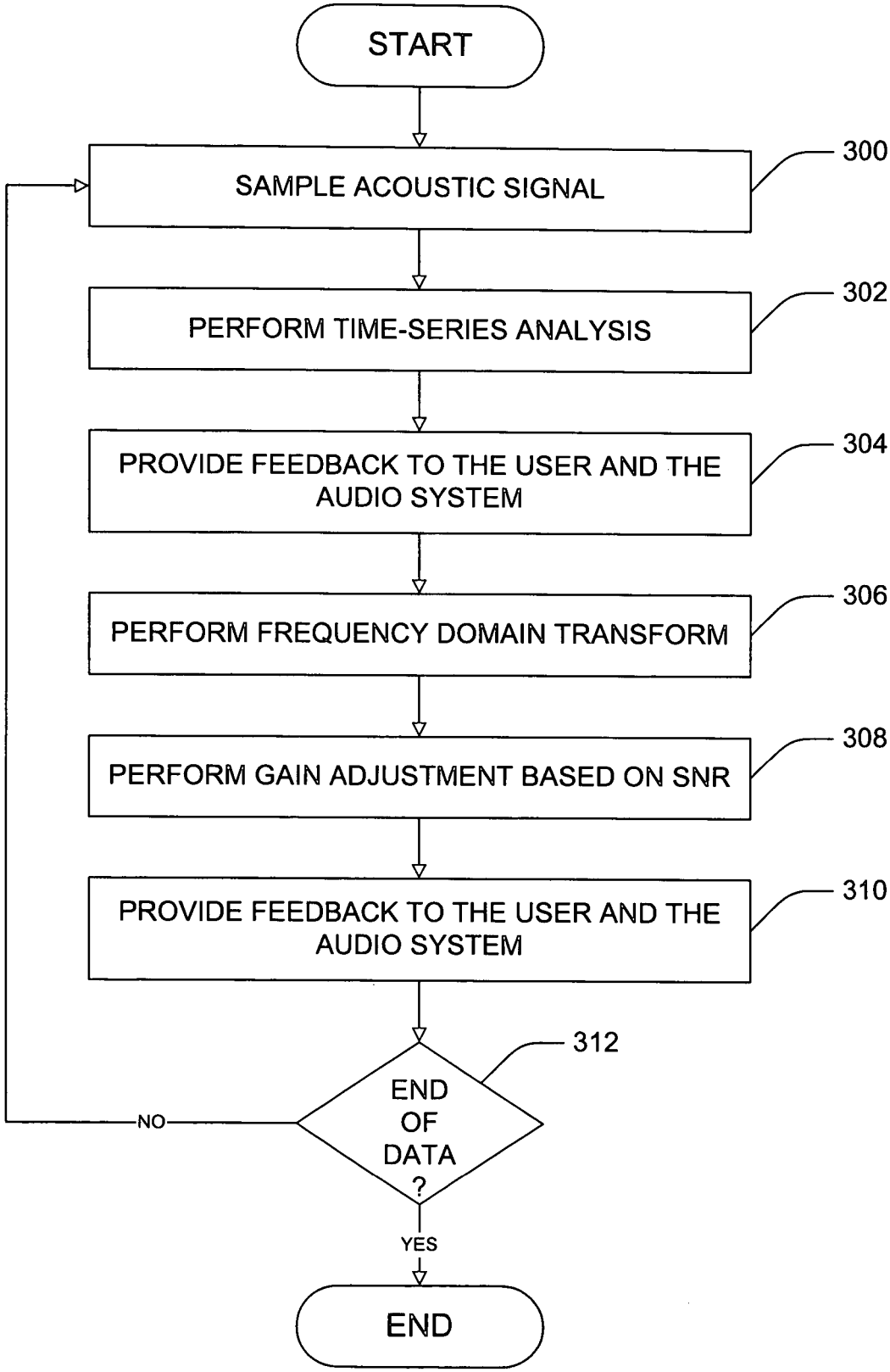
FIG. 3 is a method for monitoring an acoustic signal in accordance with an embodiment of the present invention.

FIG. 3 is a method for monitoring an acoustic signal in accordance with an embodiment of the present invention. The incoming acoustic signal includes a plurality of data samples generated as output from the A-to-D converter.

The incoming data stream is read into a computer memory as a set of samples at 300. In some embodiments, the method is applied to enhance a "moving window" of data representing portions of a continuous acoustic data stream until the entire data stream is processed. Generally, an acoustic data stream to be enhanced is represented as a series of data "buffers" of fixed length, regardless of the duration of the original acoustic data stream.

At 302, an analysis of the acoustic time series is performed on the sampled data stream. The analysis enables detection of the microphone's on/off state. The analysis also enables adjustment of overall gains to prevent clipping or overloading of the amplifier. If any one of these conditions occurs, a message is provided to the user and the audio system at 304.

A frequency domain transformation is performed at 306 to enable frequency domain analysis. Gain adjustment is performed at 308 based on frequency domain analysis of the acoustic signal-to-noise ratio. The frequency domain analysis allows detection of improper placement of the microphone with respect to the audio source. If undesirable placement of the microphone is detected, a message is sent to the user at 310 suggesting a list of corrective actions appropriate to the situation. If end of data is detected at 312, the process terminates. Otherwise, the above steps are repeated for next stream of data.

Figure 4:
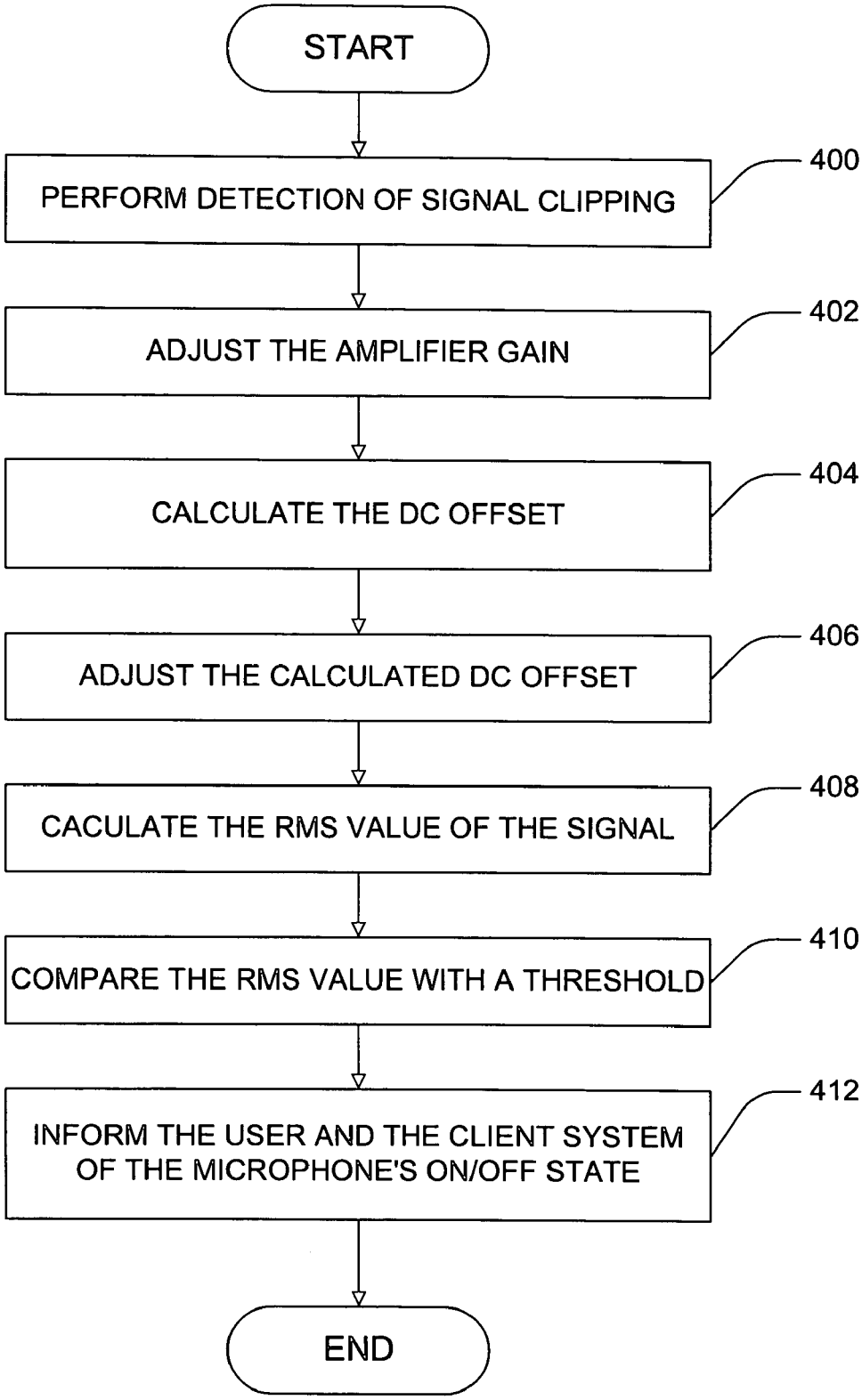
FIG. 4 is a flowchart of an acoustic time series analysis in accordance with an embodiment of the present invention.

A flowchart of an acoustic time series analysis is shown in FIG. 4 in accordance with an embodiment of the present invention. At 400, an acoustic signal is analyzed in time domain to perform detection of signal clipping. If the signal is clipped, the gain of the amplifier is adjusted at 402. At 404, a DC offset is calculated. The calculated DC offset may then be adjusted at 406. At 408, a root-mean-squared (RMS) value of the acoustic signal may be calculated to determine the on/off state of the microphone.

The determination of the on/off state involves comparing the RMS value of the data with a threshold at 410. The threshold value may be adjusted for each system in a separate calibration phase. If the RMS value is below the threshold, a message is sent to both the user display and the client system at 412. The message informs the user and the client system that the microphone is turned off at the present. The client system includes an automatic speech recognition system, or a communication system.

Figure 5:
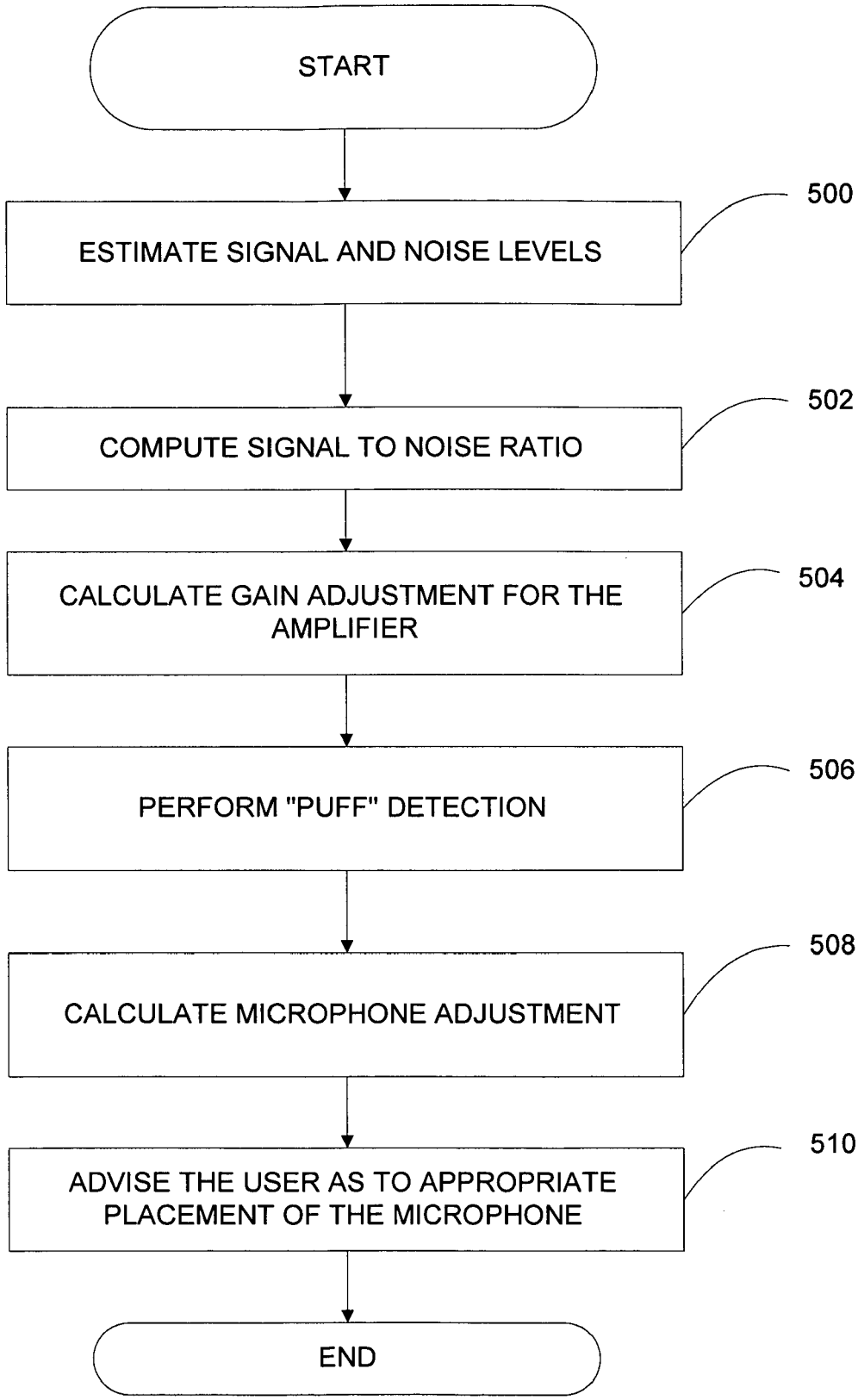
FIG. 5 is a flowchart of a joint time series and spectrum analysis according to an embodiment of the present invention.

A flowchart of joint time series and spectrum analysis is illustrated in FIG. 5. "Signal" and "noise" levels are determined at 500. Here the "signal" is defined as the data of interest for the client system, and the "noise" is defined as everything else. For example, speech is a signal for a client system that performs automatic speech recognition. In the illustrated embodiment, the signal detector may be a harmonic detector. A signal-to-noise ratio (S/N) is calculated from the estimated signal and noise levels.

The S/N over a period long enough to be representative of the overall S/N is estimated at 502. If the amplifier gain is found to be too low or too high by the calculation, then a feedback signal is sent to the amplifier to adjust the gains accordingly at 504.

The frequency domain signal may be analyzed to determine proper placement of the microphone. For example, if the microphone is placed too close to the audio source, "puffing" may be detected at 506. This condition is provided to the user through a user display. The frequency domain signal may be monitored for a low S/N ratio indicating a microphone too far from the audio source at 508. The user may be advised to talk louder, or move the microphone closer to the mouth, or improve the environment by moving to somewhere less noisy, or put on a headset microphone at 510.

The invention may be implemented in hardware or software, or a combination of both (e.g., programmable logic arrays). Unless otherwise specified, the algorithms included as part of the invention are not inherently related to any particular computer or other apparatus. In particular, various general-purpose machines may be used with programs written in accordance with the teachings herein, or it may be more convenient to construct more specialized apparatus to perform the required method steps. However, the invention may be implemented in one or more computer programs executing on programmable systems each comprising at least one processor, at least one data storage system (including volatile and non-volatile memory and/or storage elements), at least one microphone. The program code is executed on the processors to perform the functions described herein.

Each such program may be implemented in any desired computer language (including machine, assembly, high level procedural, or object oriented programming languages) to communicate with a computer system. In any case, the language may be a compiled or interpreted language.

Each such computer program is preferably stored on a storage media or device (e.g., ROM, CD-ROM, or magnetic or optical media) readable by a general or special purpose programmable computer, for configuring and operating the computer when the storage media or device is read by the computer to perform the procedures described herein. The inventive system may also be considered to be implemented as a computer-readable storage medium, configured with a computer program, where the storage medium so configured causes a computer to operate in a specific and predefined manner to perform the functions described herein.

A number of embodiments of the invention have been described. Nevertheless, it will be understood that various modifications may be made without departing from the spirit and scope of the invention. For example, some of the steps of the algorithms may be order independent, and thus may be executed in an order other than as described above. Accordingly, other embodiments are within the scope of the following claims.

What is claimed is:

1. A product comprising:

a machine readable medium; and a program encoded on the medium which causes a processor in an acoustic signal monitoring system to:

receive an acoustic signal from a microphone;

analyze time series data obtained from the acoustic signal to determine whether the microphone is 'on' or whether the microphone is 'off';

transform the acoustic signal into a frequency domain signal;

determine undesirable microphone placement by:

determining whether the microphone is too close to a user by detecting an air puff based on the frequency domain signal;

determining a signal-to-noise ratio of the frequency domain signal; and determining whether the microphone is too far from the user based on the signal-to-noise ratio; and reporting to a user, through a user display, whether the microphone is too close or too far, and whether the microphone is 'on' or 'off'.

2. The product of claim 1, where reporting includes suggesting an action for the user to take to correct for the undesirable microphone placement.

3. The product of claim 2, where the action is at least one of: 'talk louder', 'move the microphone closer', 'move somewhere less noisy', or 'put on a headset microphone'.

4. The product of claim 1, where the program further causes the processor to:

determine a RMS value of the acoustic signal; and compare the RMS value to a threshold to determine whether the microphone is 'on' or 'off'.

5. The product of claim 1, where the program further causes the processor to:

detect clipping of the acoustic signal; and report the clipping to the user through the user display.

6. The product of claim 1, where the processor continuously determines whether the microphone is 'on' or 'off'.

7. The product of claim 1, where the processor continuously determines undesirable microphone placement.

8. The product of claim 1, where the processor continuously determines undesirable microphone placement and whether the microphone is 'on' or 'off'.

* * * * *

UNITED STATES PATENT AND TRADEMARK OFFICE

CERTIFICATE OF CORRECTION

PATENT NO. : 7,058,190 B1
APPLICATION NO. : 09/576656
DATED : June 6, 2006
INVENTOR(S) : Pierre Zakarauskas et al.

It is certified that error appears in the above-identified patent and that said Letters Patent is hereby corrected as shown below:

On the Title Page

Item (75), after "Richard Sones," replace "Vancouver (CA);" with --Port Coquitlane (BC);--.

Item (75), after "Rod Rempel", replace "Port Coquitlane (CA);" with --Vancouver (BC);--.

Signed and Sealed this

Sixteenth Day of March, 2010

David J. Kappos

David J. Kappos
*Director of the United States Patent and Trademark Office*